US005768891A

United States Patent [19]

Wagner

[11] Patent Number: 5,768,891

[45] Date of Patent: Jun. 23, 1998

[54] EXHAUST SYSTEM WITH SCAVENGING VENTURI

[76] Inventor: Dane Wagner, P O Boc 211291, Anchorage, Ak. 99521

[21] Appl. No.: 713,120

[22] Filed: Sep. 16, 1996

[51] Int. Cl.[6] ..... F01N 7/10

[52] U.S. Cl. ..... 60/313; 60/323

[58] Field of Search ..... 60/323, 313

[56] References Cited

U.S. PATENT DOCUMENTS

| | | | |
|---|---|---|---|
| 3,453,824 | 7/1969 | Biesecker | 60/313 |
| 3,470,690 | 10/1969 | Thompson | 60/323 |
| 3,491,534 | 1/1970 | Garner | 60/313 |
| 3,507,301 | 4/1970 | Larson | 60/323 |
| 4,182,121 | 1/1980 | Hall | 60/313 |
| 4,373,329 | 2/1983 | Martini | 60/323 |
| 4,795,420 | 1/1989 | Sakurai et al. | 60/323 |
| 4,796,426 | 1/1989 | Feuling | 60/323 |
| 5,148,597 | 9/1992 | Weeks | 60/323 |
| 5,216,883 | 6/1993 | Flugger | 60/313 |

*Primary Examiner*—Marguerite McMahon
*Attorney, Agent, or Firm*—Michael J. Tavella

[57] ABSTRACT

A collector system for exhausts that uses a junction to merge the an engine's primary tubes in a linear arrangement. Thus, all exhaust gas passes cleanly through the unit with no interference or creating any hot spots than can fail. To help remove exhaust gas from the junction portion of the collector, a venturi pipe is installed in the system. This venturi acts to scavenge the junction pipe of any remaining exhaust before the next impulse come through the system. Finally, to eliminate the complex welding of the primary tubes and to guarantee a seal, a tube sheet is used. This tube sheet accepts each of the primary tubes. Each pipe is then welded to the tube sheet, which then fits over the end of the collector junction. The tube sheet is then welded to the junction and the system is sealed.

8 Claims, 7 Drawing Sheets

EXHAUST SYSTEM WITH SCAVENGING VENTURI

This invention is related exhaust systems for airplanes and other vehicles and more particularly to exhaust systems that utilize a vernturi to better scavenge the exhaust pipe.

BACKGROUND OF THE INVENTION

Most engines have exhaust systems that attach to the manifold. These systems are called collectors because that gather the exhaust from the manifold in individual primary tubes and then merge all the tubes into a common collector for connection to a muffler. In many cases, especially for aircraft, little thought is put into optimizing the configuration of these primary tubes to achieve better engine performance and longer collector life. In the aftermarket, many exhaust systems are sold to improve performance from race cars to motor homes. Typically, these systems attempt to tune the primary tubes so that as each cylinder exhausts, the impulse of exhaust gas from that cylinder travels down the primary tube and arrives at the junction point of all the primary tubes at a different time from the other cylinders. This leads to a constant flow of exhaust moving through the collector without impediment. The way to do this is to adjust the length of the primary tubes so that the travel time of the exhaust gasses through each tube is coordinated. Of course, finding the correct length for each tube and then assembling the unit into a practical package can be difficult.

As mentioned above, the problem of aircraft collectors is even more acute. In one design, the primary tubes (or risers) come into a common manifold facing one another. The exhaust gas from one riser is aimed at an adjacent riser. Moreover, the collector has a small space between the main exhaust pipe outlet and the individual risers. In this configuration, hot exhaust gas impinges on the joints of the assembly. This eventually causes metal fatigue of the joints and premature failure of the collector.

FIG. 1 shows this configuration. In this figure, a prior art exhaust system 1 is made up of three risers 2, 3, and 4. The risers 2, 3, and 4 feed into a collector 5. The collector 5 then feeds the exhaust through an outlet 6 to a muffler (not shown) and, eventually to an exhaust tailpipe (also not shown). As shown in FIG. 1, the exhaust gasses (see the directional arrows) move through risers 2, 3 and 4 as shown. The exhaust gasses mix within the collector 5 and create turbulence, which not only reduces the efficiency of the exhaust system, but exposes the risers to hot exhaust gasses, which causes metal fatigue within the collector 5, causing it to fail over time.

In the design of FIG. 1, there is no active system to clear the collector 5 of gasses between impulses from the engine. Unless these gasses clear completely, excessive pressures can be created within the exhaust system. Moreover, as discussed above, hot spots can also form on various sections of the collector 5.

Exhaust systems for other types of vehicles attempt to solve this problem by aligning the primary tubes in more of a straight path when they enter the collector. Some examples of these systems are found in the following U.S. Pat. Nos. 4,373,329 to Martini, 4,953,352 to Campbell, 5,148,597 to Weeks, 5,216,883 to Flugger, and 4,800,719 to Campbell.

One problem encountered with this type of exhaust collector construction is in the construction of the collector itself. The primary tubes must be properly welded together to seal the collector junction. Such a seal is important to ensure no leakage from the pipes. Welds must be made all around the pipes and even in between the pipes to make a good seal. This is difficult if not impossible. As a result, many of the welds are overdone or are poor. Even if the welds are done properly, such welds are time consuming and expensive to make.

SUMMARY OF THE INVENTION

The present invention overcomes these difficulties. It is a collector system that uses a junction to merge an engine's primary tubes in a linear arrangement. Thus, all exhaust gases pass cleanly through the unit with no interference. The linear path also eliminates any hot spots than can eventually cause part failure. To help remove exhaust gas from the junction portion of the collector, a venturi pipe is installed in the system. This venturi acts to scavenge the junction pipe of any remaining exhaust before the next impulse come through the system. Finally, to eliminate the complex welding of the primary tubes and to provide a guaranteed seal, a tube sheet is provided. This tube sheet accepts each of the risers. Each riser is then welded to the tube sheet, which then fits over the end of the collector junction. The tube sheet is then welded to the junction and the system is sealed. Besides providing a good seal for the risers and collector, the tube sheet has spacers formed between the primary tube receptacles. This space acts to cool the risers by allowing cooling air to flow around the risers. This then provides better cooling for the risers, thereby decreasing the potential for burn through.

It is an object of this invention to produce an aircraft exhaust system that has a non-conflicting pipe arrangement that prevents burn through of exhaust system components.

It is another object of this invention to produce an aircraft exhaust system that uses a venturi system to scavenge the exhaust pipes to provide a clear exhaust path for each exhaust impulse.

It is yet another object of this invention to produce an aircraft exhaust system that uses a tube sheet to ensure proper welding is performed on the exhaust pipes and to ensure that the exhaust pipes properly seal to the collectors.

DETAILED DESCRIPTION OF THE INVENTION

Figure 1:
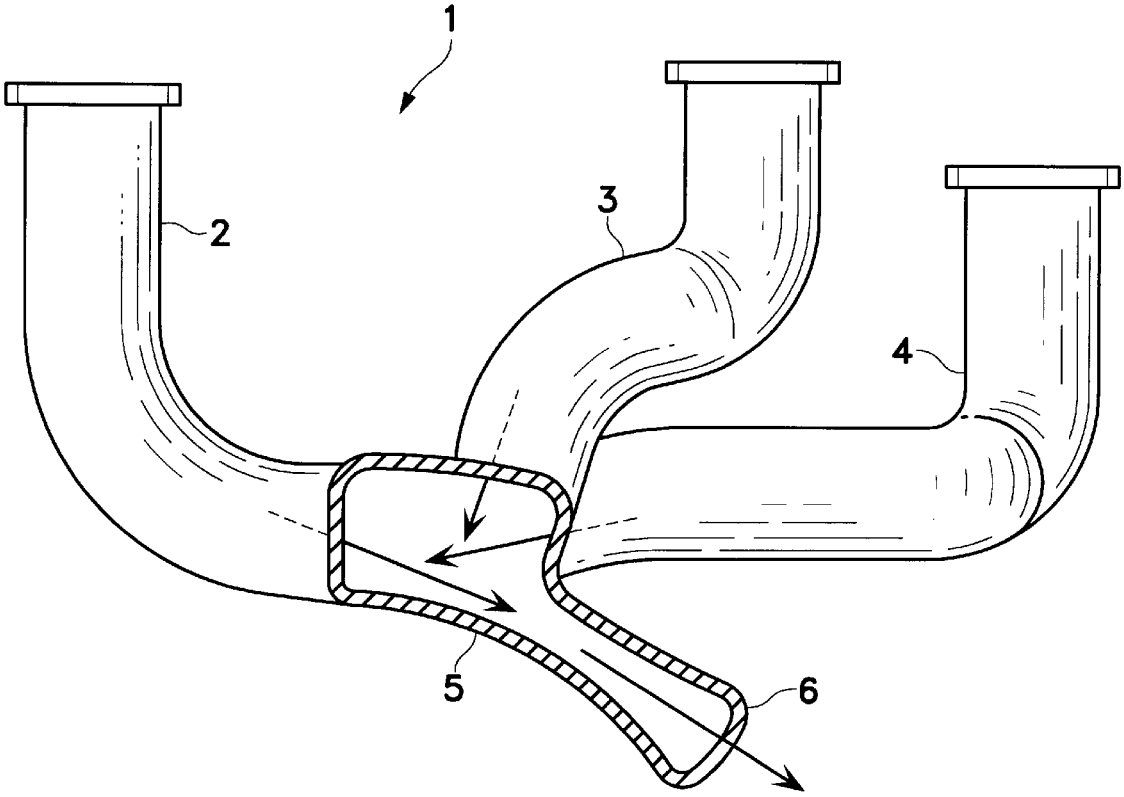
Fig. 1 (Prior Art)
FIG. 1 is a side representational view of a typical exhaust system as prior art.
Figure 2:
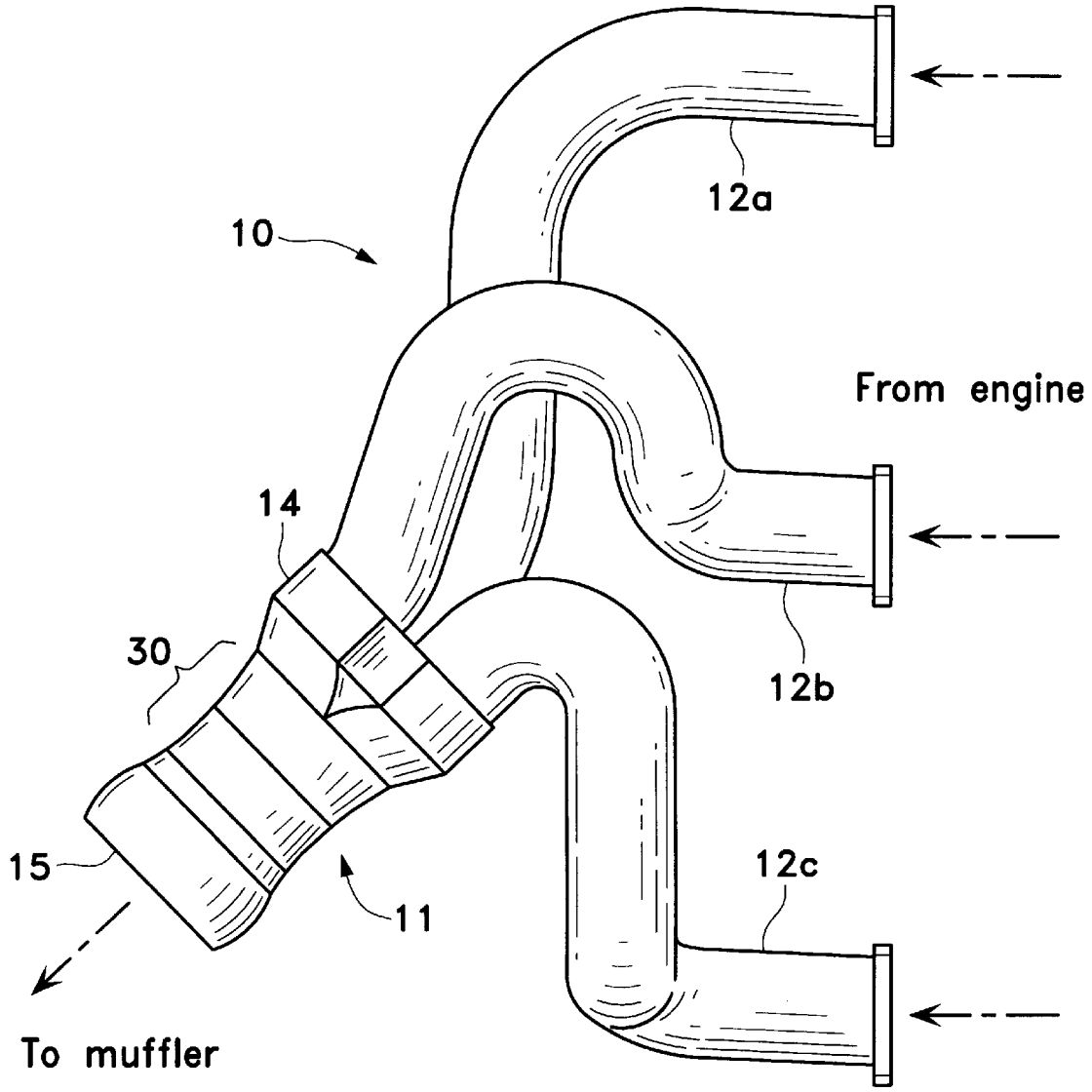
FIG. 2 is a side view of a typical exhaust system for the left side of an aircraft engine showing the collector and three primary tubes.
Figure 3:
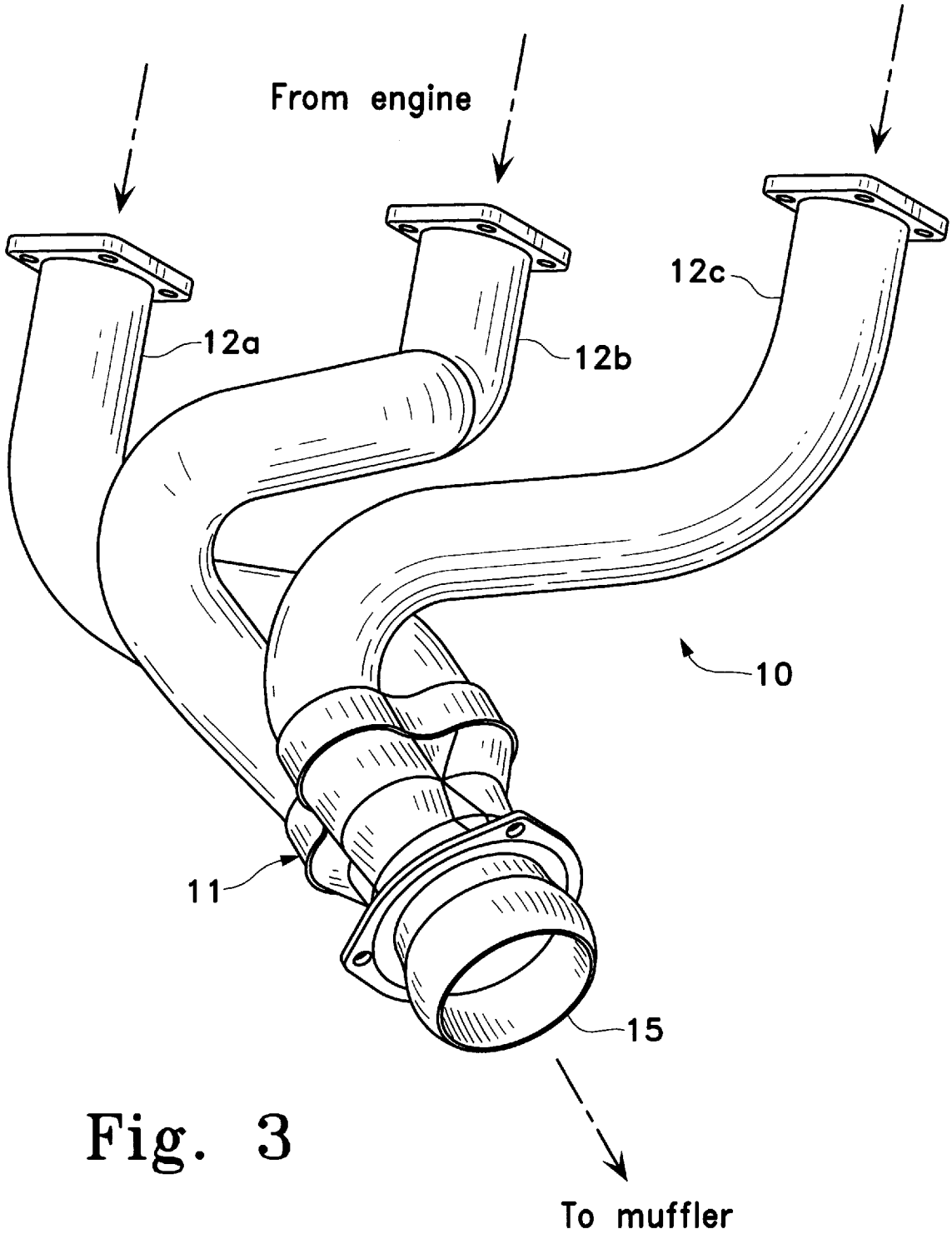
FIG. 3 is another side view of a typical exhaust system for the left side of an aircraft engine showing the collector and three primary tubes.

Referring now to FIG. 2, my new collector and exhaust system 10 is shown. This system 10 has three main components. First is the collector 11. The second is the primary tubes 12*a*, 12*b*, and 12*c*. Note that this 19 system 10 shows three primary tubes. However, the collector 11 can be easily adapted to us two, four or five primary tubes, as desired. FIG. 2 shows primary tubes 12*a*, 12*b*, and 12*c*, configured for a CESSNA 207 left hand manifold. FIG. 3 shows the same configuration for the right hand manifold. The length and the curvature of the risers 12*a*, 12*b*, and 12*c* are entirely dependent on the type of plane or vehicle being outfitted with the system 10. As such, the exact length and curvature of the primary tubes 12*a*, 12*b*, and 12*c* must be modified for each engine. Such calculations are well known in the art and are beyond the scope of this patent.

Figure 5:
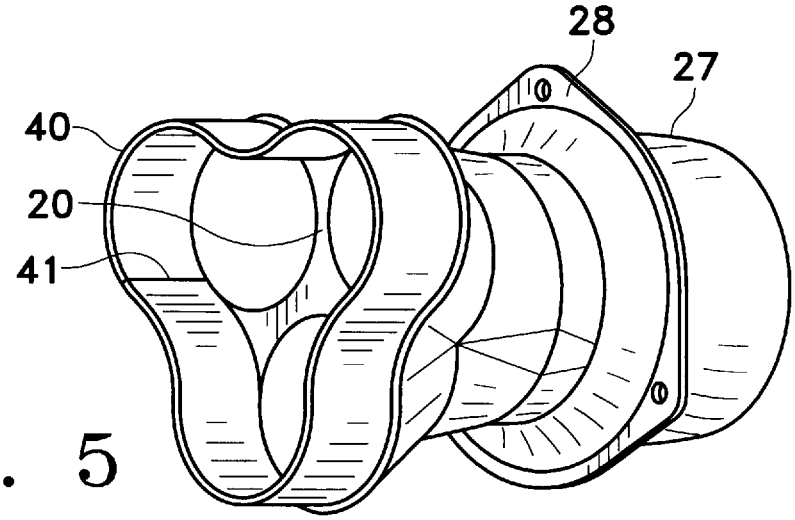
FIG. 5 is a forward perspective view of the collector showing the tube sheet and stiffener installed.
Figure 6:
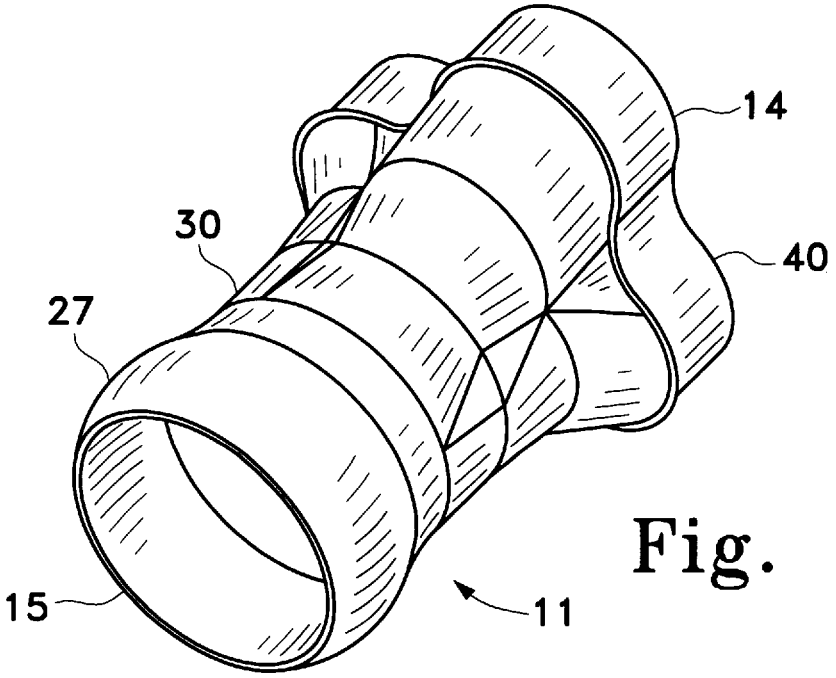
FIG. 6 is a rear perspective view of the collector showing the outlet end.
Figure 7:
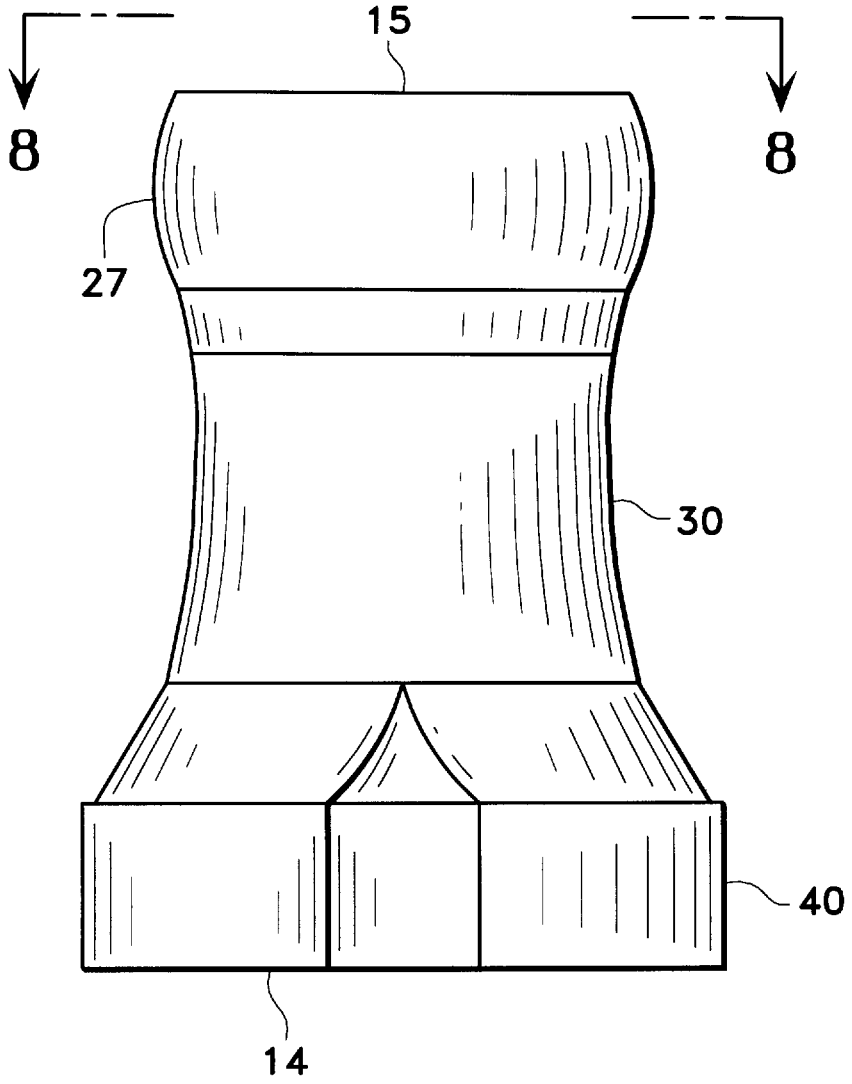
FIG. 7 is a side view of the collector having a linear body, and showing the venturi and the stiffener.
Figure 8:
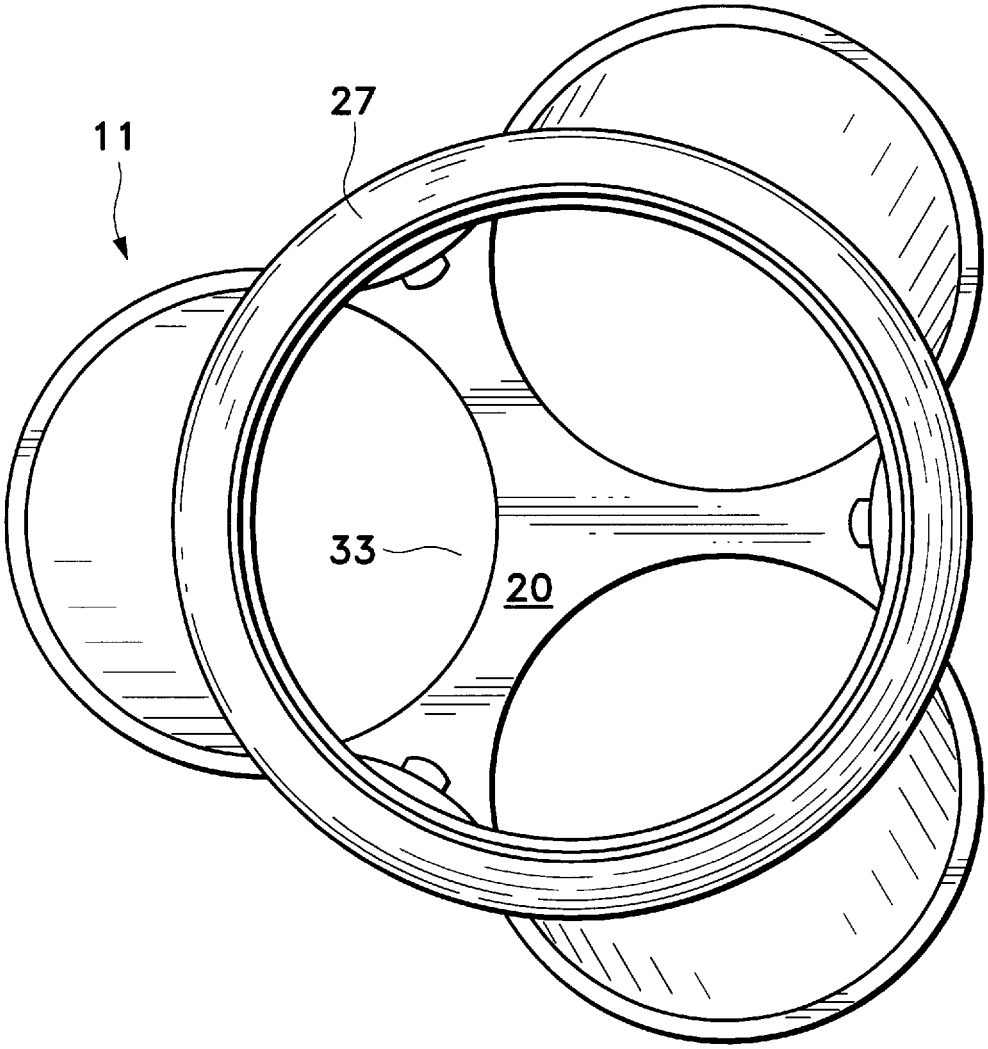
FIG. 8 is an outlet end view of the collector taken along the lines 8—8 of FIG. 7.

Once the primary tubes 12*a*, 12*b*, and 12*c* have been laid out, the free ends of the risers 12*a*, 12*b*, and 12*c* are gathered into the collector 11. As shown in FIGS. 2 and 3, the collector 11 has two ends: an inlet end 14 and an outlet end 15. Details of the outlet end 15 are shown in FIGS. 3, 6, and 8. Unlike some prior art exhaust system designs, where the primary tubes are placed into a collector and group welded (which is a difficult operation), the instant invention includes a tube sheet 20. See FIG. 9. The tube sheet 20 has an outer perimeter that matches the perimeter of the collector 11 (see, e.g., FIGS. 5 and 7). The tube sheet 20 also has a number of sized holes 21 to accommodate the primary tubes 12*a*, 12*b*, and 12*c*. The number of holes 21 varies depending on the number of primary tubes.

Figure 4:
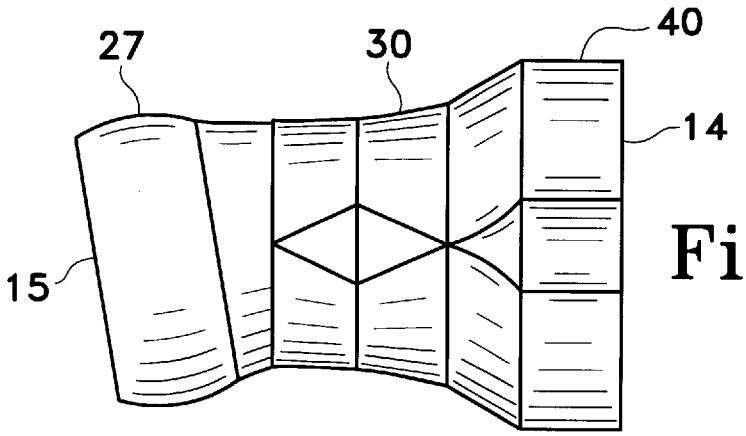
FIG. 4 is a side view of one embodiment of the collector showing the venturi end.

Another unique feature of this collector 11 is the venturi scavenger 30. As shown in FIGS. 2, 4 and 7, the space 30 between the inlet end 14 and the outlet end 15 is narrower than either of the two ends. This constriction between two wide ends produces a venturi 30. The venturi 30 accelerates the exhaust moving through the center channel 33 (see FIG. 8) of the collector 11. This produces a partial vacuum at the inlet end 14. As such, exhaust gasses are pulled cleanly from the primary tubes 12*a*, 12*b*, and 12*c* on each cycle. This leaves the collector 11 clear to receive the successive exhaust impulses from the engine and prevents gas buildup or turbulence within the collector 11.

Referring now to FIGS. 5–9, details of the collector 11 are now provided. At the outlet end 15 of the collector 11 there is a male ball joint 27 for attaching to the aircraft exhaust system. Behind the ball joint 27 is a ball joint flange 28 for securing the ball joint to the aircraft muffler (see, e.g., FIG. 5). FIG. 4 shows the male ball joint 27 at a 41 degree angle. This bend is necessary to ensure that the ball joint 27 aligns with the matching ball joint on the muffler. This view shows that the collector 11 elements need not be always in a linear relationship, but may be adjusted to accommodate the physical arrangements of particular vehicles.

After the ball joint, 27, the collector 11 then necks down to form the venturi 30. The collector 11 then begins to open out to accommodate the primary tubes 12*a*, 12*b*, and 12*c*. This section has three semi-circular wall sections 28 that match the outside diameters of the primary tubes 12*a*, 12*b*, and 12*c*. This section can also be tapered, as shown, forming a number of semi-hemispherical frusto conical sections.

Figure 9:
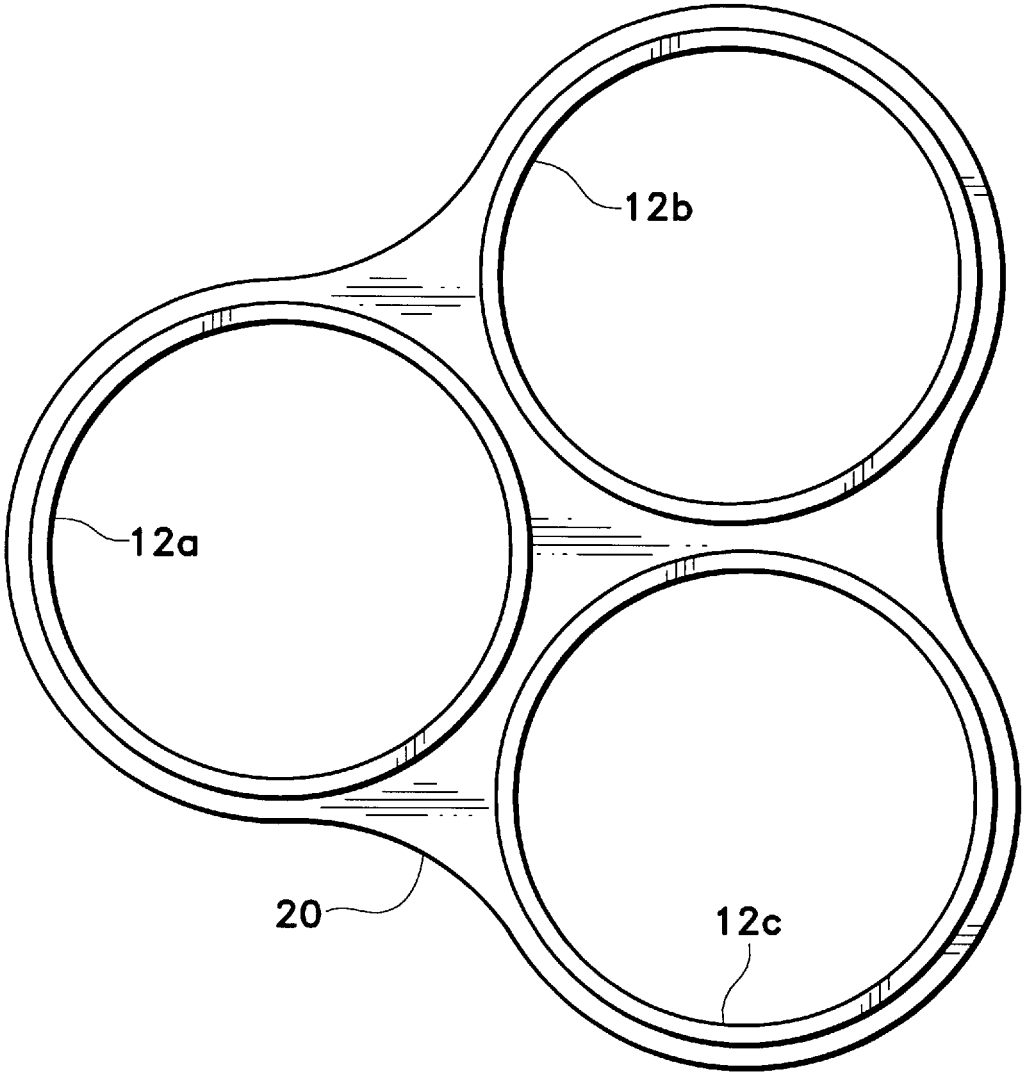
FIG. 9 is an end view of the tube sheet with the primary tubes attached.

Referring now to FIG. 9, unlike the prior art, the tube sheet 20 provides room to weld the end of each riser 12 to the tube sheet 20. Because the tube sheet 20 is solid between the risers 12, there is no need to weld between the risers 12 to make an effective seal. Moreover, the spacing between the primary tubes 12*a*, 12*b*, and 12*c* at the tube sheet 20 forms an airspace between the primary tubes 12*a*, 12*b*, and 12*c* that helps to cool them. The primary tubes 12*a*, 12*b*, and 12*c* are placed into the holes 21 in the tube sheet 20, and aligned flush. The primary tubes 12*a*, 12*b*, and 12*c* can then be welded to the tube sheet 20 about their full circumferences. Once the risers 12 are welded to the tube sheet 20 and the tube sheet 20 is welded to the collector 11, the seal is automatically made. Finally, a stiffener band 40 is added to tie the structure together. This band 40 is welded in place after the tube sheet 20 has been welded to the collector 11. The stiffener 40 is formed around the primary tubes 12*a*, 12*b*, and 12*c* and then welded at the seam 41 and to the primary tubes 12*a*, 12*b*, and 12*c* about their outer perimeters.

The primary tubes 12*a*, 12*b*, and 12*c* and the collector 11 are made of tubing according to standard practice. Each primary tube 12 has a mounting flange 70 installed on its free end as shown. The flanges 70 vary from aircraft to aircraft. Just as the flanges 70 vary from aircraft to aircraft, the angles and bends of the primary tubes 12*a*, 12*b*, and 12*c* also varies. As discussed above, the design of tuned primary tubes is beyond the scope of this patent. The important point is that the outlet ends of the primary tubes 12*a*, 12*b*, and 12*c* are brought together into the collector 11 in a linear plane, rather then entering the collector 11 at different angles. This eliminates the problems experienced in the prior art designs where the exhaust gasses of one pipe are aimed at one wall of the collector 11, which causes to collector 11 to burn through and fail.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A collector for engines having a number of primary tubes, each primary tube having an inlet end and an outlet end, comprising:

a) a generally cylindrical member, having an inlet end, an outlet end, and a cross-sectional area, wherein the inlet end of said generally cylindrical member has a plurality of semi-circular wall members formed thereon that correspond to the number of primary tubes and further such that said plurality of semi-circular wall members align with and cause said number of primary tubes to be arranged in a linear alignment within said plurality of semi-circular wall members, and further such that said plurality of semi-circular wall members have an inner perimeter, and a cross-sectional area substantially larger than the cross sectional area of the generally cylindrical member;

b) a means for attaching said collector to an exhaust system, fixedly attached to said outlet end of said generally cylindrical member; wherein said means for attaching said collector to an exhaust system has a cross-sectional area substantially larger than cross sectional area of the generally cylindrical member, thereby forming a venturi between said inlet end and said outlet end of said generally cylindrical member; and c) a means for attaching said number of primary tubes to said collector, including a tube sheet, having an outer perimeter that conforms to the inner perimeter of said plurality of semi-circular openings, said tube sheet also having a plurality of holes formed therein that conform to the number of primary tubes and further such that said plurality of holes maintain said number of primary tubes in a linear alignment when said number of primary tubes are attached to said tube sheet.

2. The collector of claim 1 wherein the means for attaching said collector to an exhaust system comprises a male ball joint.

3. The collector of claim 1 further comprising a stiffener band, fixedly attached to said tube sheet and extending about, and being fixedly attached to, said plurality of primary tubes.

4. A collector for engines having a number of primary tubes, each primary tube having an inlet end and an outlet end, comprising:

a) a generally cylindrical member, having an inlet end, an outlet end, and a cross-sectional area;

b) a number of semi-hemispherical frusto conical sections, fixedly attached to the inlet end of said generally cylindrical member whereby the number of semi-hemispherical frusto-conical sections corresponds to the number of primary tubes, and further, such that said number of semi-hemispherical frusto-conical sections have an inner perimeter and a cross-sectional area substantially greater than said generally cylindrical member;

c) An outlet member, fixedly attached to said outlet end of said generally cylindrical member; wherein said outlet member has a cross-sectional area substantially larger than cross sectional area of the generally cylindrical member, thereby forming a venturi between said inlet end and said outlet end of said generally cylindrical member; and d) a means for attaching said number of primary tubes to said collector, including a tube sheet, having an outer perimeter that conforms to the inner perimeter of said number of semi-hemispherical frusto-conical sections, said tube sheet also having a plurality of holes formed therein that conform to the number of primary tubes and further such that said plurality of holes maintain said number of primary tubes in a linear alignment when said number of primary tubes are attached to said tube sheet.

5. The collector of claim 4 wherein said number of primary tubes are arranged in a linear alignment.

6. The collector of claim 4 wherein the outlet member comprises a male ball joint.

7. The collector of claim 4 further comprising a stiffener band, fixedly attached to said tube sheet and extending about and being fixedly attached to said number of primary tubes.

8. A collector for engines having a number of primary tubes, each primary tube having an inlet end and an outlet end, comprising:

a) a generally cylindrical member, having an inlet end, an outlet end, and a cross-sectional area;

b) a number of semi-hemispherical frusto-conical sections, fixedly attached to the inlet end of said generally cylindrical member whereby the number of semi-hemispherical frusto-conical sections corresponds to the number of primary tubes and further, such that said number of semi-hemispherical frusto-conical sections have an inner perimeter and a cross-sectional area substantially greater than said generally cylindrical member;

c) A male ball joint, fixedly attached to said outlet end of said generally cylindrical member; wherein said male ball joint has a cross-sectional area substantially larger than cross sectional area of the generally cylindrical member, thereby forming a venturi between said inlet end and said outlet end of said generally cylindrical member;

d) a tube sheet, having an outer perimeter that conforms to the inner perimeter of said number of semi-hemispherical frusto-conical sections, said tube sheet also having a plurality of holes formed therein that conform to the number of primary tubes and further such that said plurality of holes maintain said number of primary tubes in a linear alignment when said number of primary tubes are attached to said tube sheet; and e) a stiffener band, fixedly attached to said tube sheet and extending about and being fixedly attached to said number of primary tubes.

* * * * *